US007589610B2

(12) United States Patent
Huang

(10) Patent No.: US 7,589,610 B2
(45) Date of Patent: Sep. 15, 2009

(54) OVER CURRENT CUT-OFF SWITCH

(76) Inventor: Albert Huang, 3F, No. 146, Sec. 4, Chungking N. Rd., Taipei (TW)

( * ) Notice: Subject to any disclaimer, the term of this patent is extended or adjusted under 35 U.S.C. 154(b) by 193 days.

(21) Appl. No.: 11/902,455

(22) Filed: Sep. 21, 2007

(65) Prior Publication Data

US 2009/0078556 A1 Mar. 26, 2009

(51) Int. Cl.
*H01H 37/70* (2006.01)
*H01H 37/52* (2006.01)

(52) U.S. Cl. ..... 337/66; 337/56; 337/72; 337/85; 337/59

(58) Field of Classification Search ..... 337/56, 337/72, 66, 85, 59; 200/339, 341
See application file for complete search history.

(56) References Cited

U.S. PATENT DOCUMENTS 2,811,606 A * 10/1957 Norden ..... 337/53
3,047,681 A * 7/1962 Dehn ..... 191/45 A
3,932,829 A * 1/1976 Ellenberger ..... 337/49
4,258,349 A * 3/1981 Flory ..... 337/46
4,329,669 A * 5/1982 Krasser et al. ..... 335/20
4,338,586 A * 7/1982 Scanlon ..... 337/74
4,345,233 A * 8/1982 Matthies ..... 337/75
4,528,538 A * 7/1985 Andersen ..... 337/43
4,833,439 A * 5/1989 Bowden et al. ..... 337/68
4,922,219 A * 5/1990 Bakhaus et al. ..... 337/74
5,089,799 A * 2/1992 Sorenson ..... 337/68
5,264,817 A * 11/1993 Sorenson ..... 337/68
5,491,460 A * 2/1996 Krasser et al. ..... 337/70
5,828,284 A * 10/1998 Huang ..... 337/37
5,892,426 A * 4/1999 Huang ..... 337/59
6,121,868 A * 9/2000 Chiang ..... 337/37
6,275,134 B1 * 8/2001 Chen ..... 337/37
6,307,460 B1 * 10/2001 Yu ..... 337/37
6,445,273 B1 * 9/2002 Yu ..... 337/37
6,456,185 B1 * 9/2002 Yu ..... 337/37
6,512,441 B1 * 1/2003 Yu ..... 337/37
6,552,644 B2 * 4/2003 Yu ..... 337/66
6,563,414 B2 * 5/2003 Yu ..... 337/66
6,617,952 B1 * 9/2003 Yu ..... 337/94
6,621,402 B2 * 9/2003 Huang ..... 337/66
6,664,884 B1 * 12/2003 Yu ..... 337/59

(Continued)

FOREIGN PATENT DOCUMENTS

GB 2177543 A * 1/1987

*Primary Examiner*—Anatoly Vortman
(74) *Attorney, Agent, or Firm*—Muncy, Geissler, Olds & Lowe, PLLC

(57) ABSTRACT

An over current cut-off switch has an electric insulating housing, a first conductive foot, a second conductive foot, a reed, an electric wire and a switch button. The housing received upper portions of the first and second conductive feet, the reed and the electric wire. The button is configured on a top of the electric insulating housing. One end of the reed uses a connecting conductor to rivet to the first conductive foot. The other free end of the reed is separately connected to a top of the second conductive foot. The electric wire is mounted between the reed and the first conductive foot to be used as current branch. The switch button is configured on a top of the electric insulating housing. One side of a bottom of the switch button has a bump.

16 Claims, 6 Drawing Sheets

U.S. PATENT DOCUMENTS 6,674,033 B1 * 1/2004 Wang ..... 200/334
6,714,116 B1 * 3/2004 Sang et al. ..... 337/68
6,734,779 B2 * 5/2004 Yu ..... 337/59
6,992,559 B2 * 1/2006 Huang ..... 337/66
7,355,139 B1 * 4/2008 Yu ..... 200/400
7,518,482 B2 * 4/2009 Fleege ..... 337/59
2003/0160679 A1 * 8/2003 Yu ..... 337/37
2005/0190521 A1 * 9/2005 Huang ..... 361/105
2008/0074231 A1 * 3/2008 Huang ..... 337/70

* cited by examiner

OVER CURRENT CUT-OFF SWITCH

BACKGROUND OF THE INVENTION

1. Field of the Invention

The invention relates in general to a power switch, and more particularly to an over current cut-off switch.

2. Description of the Related Art

With reference to FIGS. 4 and 5, a conventional cut-off switch has a housing 50, a first conductive foot 51, a second conductive foot 52, a reed 53, a switch button 54 and a bump 55. The housing 50 is of an electric insulating material. The first conductive foot 51 and the second conductive foot 52 are respectively configured inside the housing 50 penetrating a bottom of the housing 50. The reed 53 is configured inside the housing 50. One end of the reed 53 is riveted to a surface of the first conductive foot 51, and the other free end of the reed 53 faces the second conductive foot 52.

The switch button 54 is configured on a top of the housing 50. One side of a bottom of the switch button 54 has the bump 55. The bump 55 penetrates inside the housing 50 facing a top of the free end of the reed 53.

When using the aforesaid cut-off switch, the switch button 54 is firstly pressed to make the bump 55 on the bottom of the switch button 54 press the reed 53 to contact the top of the second conductive foot 52 and then to be fixed. With reference to FIG. 6, when an over current flows through the cut-off switch, the reed 53 flips upward to make the first conductive foot 51 and the second conductive foot 52 disconnected. Moreover, when the reed 53 flips upward, the bump 55 above the reed 52 is also pushed to move upward, so as to switch a status of the switch button 54. When users eliminate the over current status and want to recover the disconnection status, the users only need to press the switch button 54 again to make the bump 55 press the free end of the reed 53 downward to contact the second conductive foot 52.

Although the aforesaid cut-off switch can be used repeatedly, in practical usage, the conventional cut-off device is often used under the over current status. Since the reed 53 and the first conductive foot 51 are riveted together, the reed 53 and the first conductive foot 51 are easily to become deformed due to a material feature. Hence a riveted point is easily to be broken and can not conduct electricity.

SUMMARY OF THE INVENTION

An objective of the present invention is to provide an over current cut-off switch. The present invention is aimed to effectively overcome the disadvantages of the conventional over current cut-off switch that the riveted point of the reed and the conductive foot is easily to be broken due to the over current.

In order to achieve the above objective, the over current cut-off switch is provided.

An over current cut-off switch has an electric insulating housing, a first conductive foot, a second conductive foot, a reed, an electric wire and a switch button. Upper portions of the first conductive foot and the second conductive foot are configured inside the electric insulating housing. Lower portions of the first conductive foot and the second conductive foot are penetrating outside the electric insulating housing for plugging to an external circuit. The reed has one end riveted to a surface of the first conductive foot and the other free end of the reed facing the second conductive foot. The electric wire is cross-connected to both sides of a riveted point of the reed and the first conductive foot. The switch button is configured on a top of the electric insulating housing. One side of a bottom of the switch button has a bump. The bump penetrates inside the electric insulating housing facing a top of the free end of the reed.

DETAILED DESCRIPTION OF THE INVENTION

Figure 1:
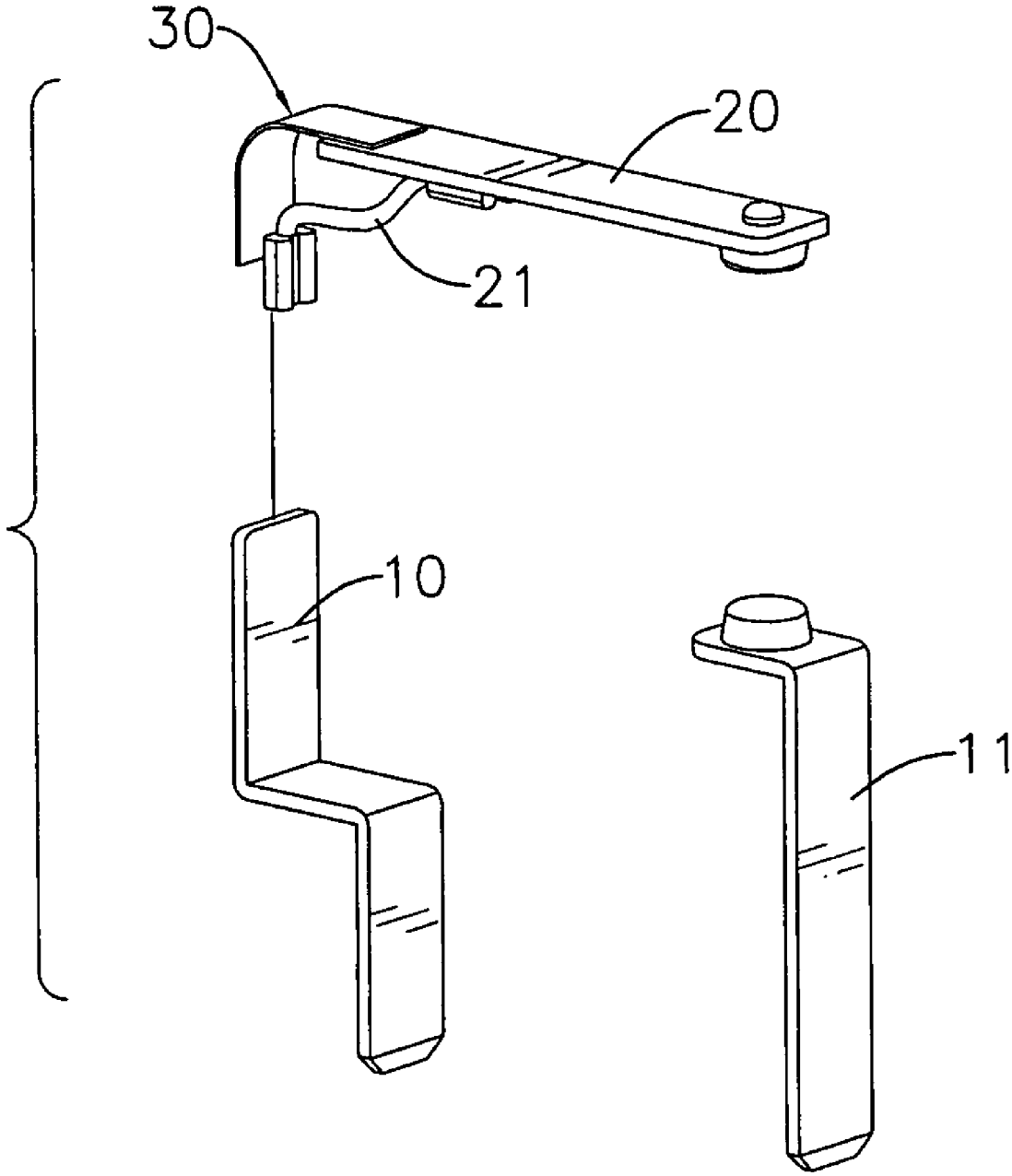
FIG. 1 is a perspective view of a part of an over current cut-off switch in accordance with the present invention.
Figure 2:
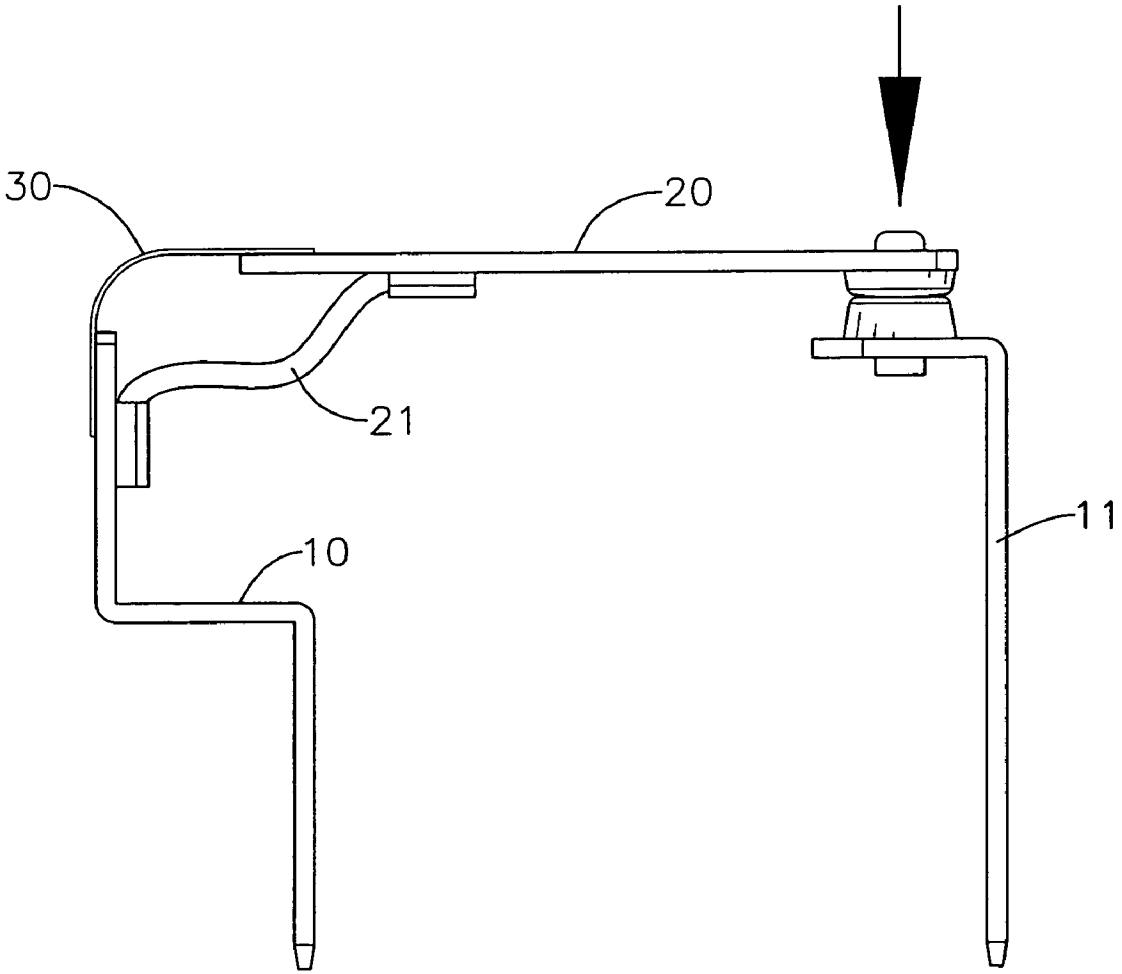
FIG. 2 is an operational side plan view of the part of the over current cut-off switch in accordance with the present invention.

With reference to FIGS. 1 and 2, a preferred embodiment in accordance with the present invention is similar to the conventional over current cut-off switch; hence an introduction of the present invention focuses on structures of a reed 20 and two conductive feet 10 and 11. An over current cut-off switch of the present invention has an electric insulating housing (not shown in the diagram), a first conductive foot 10, a second conductive foot 11, a reed 20, an electric wire 21 and a connecting conductor 30.

The electric insulating housing is of an electric insulating material. Upper portions of the first conductive foot 10 and the second conductive foot 11 are configured inside the electric insulating housing. On the other hand, lower portions of the first conductive foot 10 and the second conductive foot 11 are penetrating outside the electric insulating housing for plugging to an external circuit. The reed 20 is also inside the electric insulating housing 10 and has two ends. One free end of the reed 20 is separately connected to a top of the second conductive foot 11. The connecting conductor is mounted between the other end of the reed 20 and the upper portion of the first conductive foot 10. The reed 20 and the connecting conductor 30 are of a copper alloy sheet metal so they have resilience.

The electric wire 21 is mounted between the first conductive foot 10 and the reed 20. Therefore, the electric wire is parallel with the connecting conductor 31. The electric wire 21 may be a woven copper wire for high-amperage. In this preferred embodiment, the connecting conductor 30 has two ends. The two ends of the connecting conductor 30 are respectively to the top of the reed 20 and the outer surface of the first conductive foot 10. The electric wire 21 has two ends respectively mounted between a bottom of the reed 20 and the inner surface of the first conductive foot 10.

A switch button (not shown in the diagram) is configured on a top of the electric insulating housing. One side of a bottom of the switch button has a bump. The bump penetrates inside the electric insulating housing facing a top of the free end of the reed 20.

Figure 3:
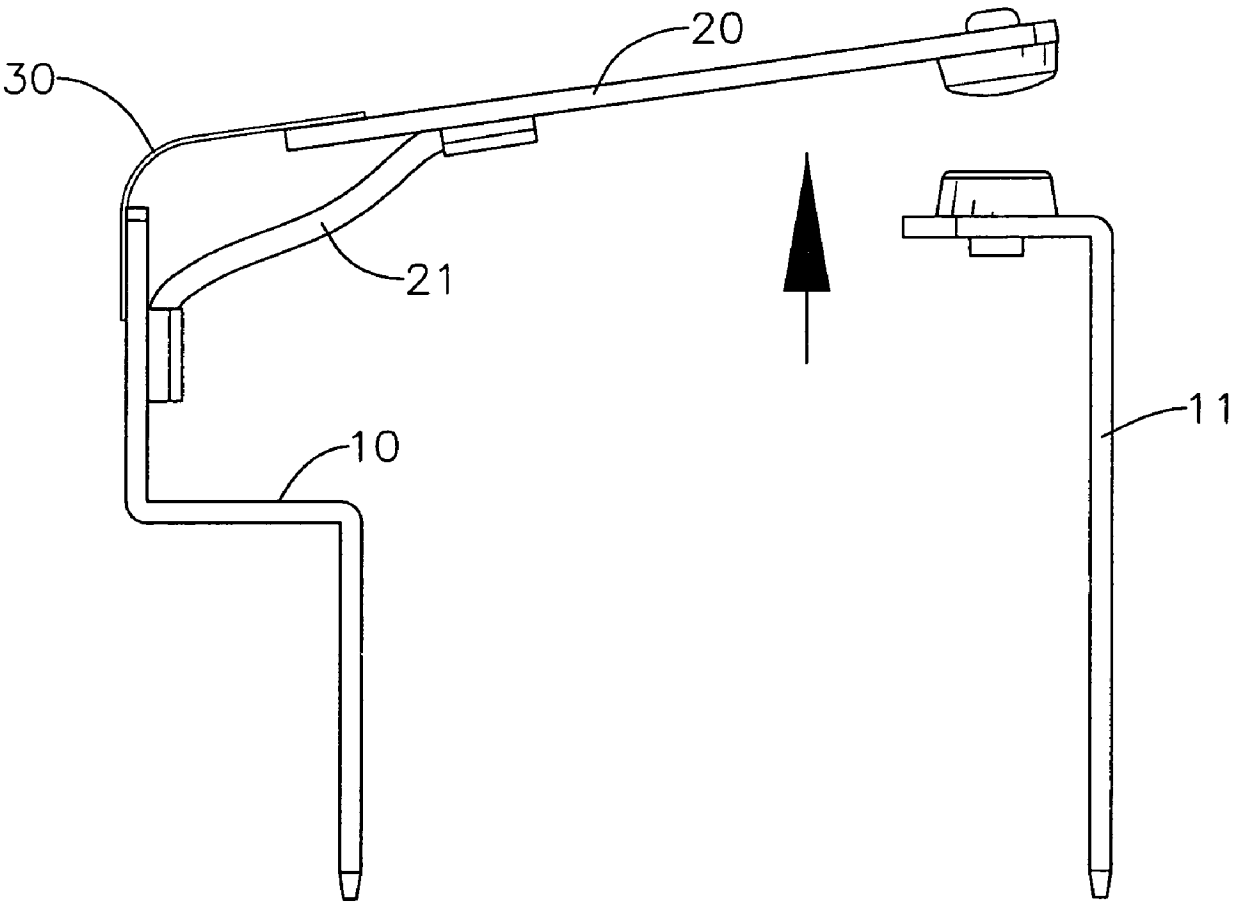
FIG. 3 is another operational side plan view of the part of the over current cut-off switch in accordance with the present invention.
Figure 4:
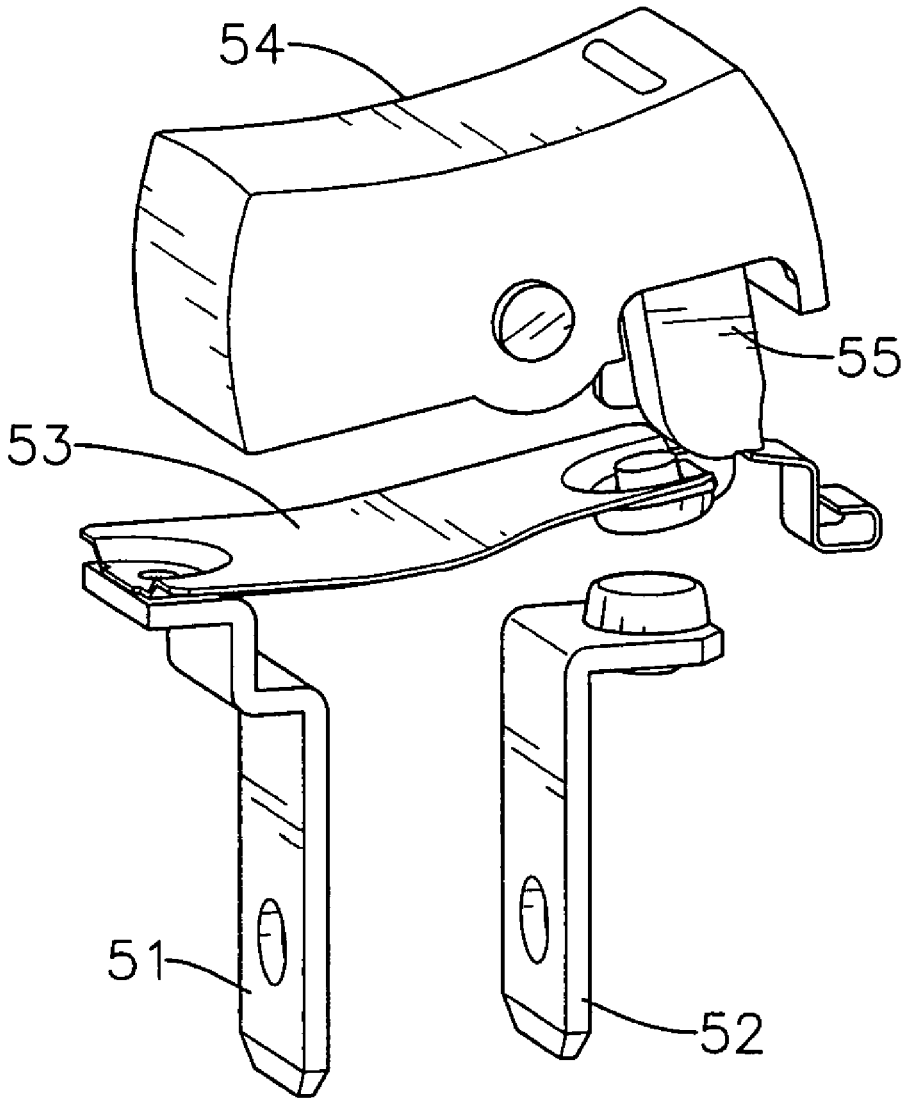
FIG. 4 PRIOR ART
FIG. 4 is a perspective view of a part of a conventional over current cut-off switch in accordance with the prior art.
Figure 5:
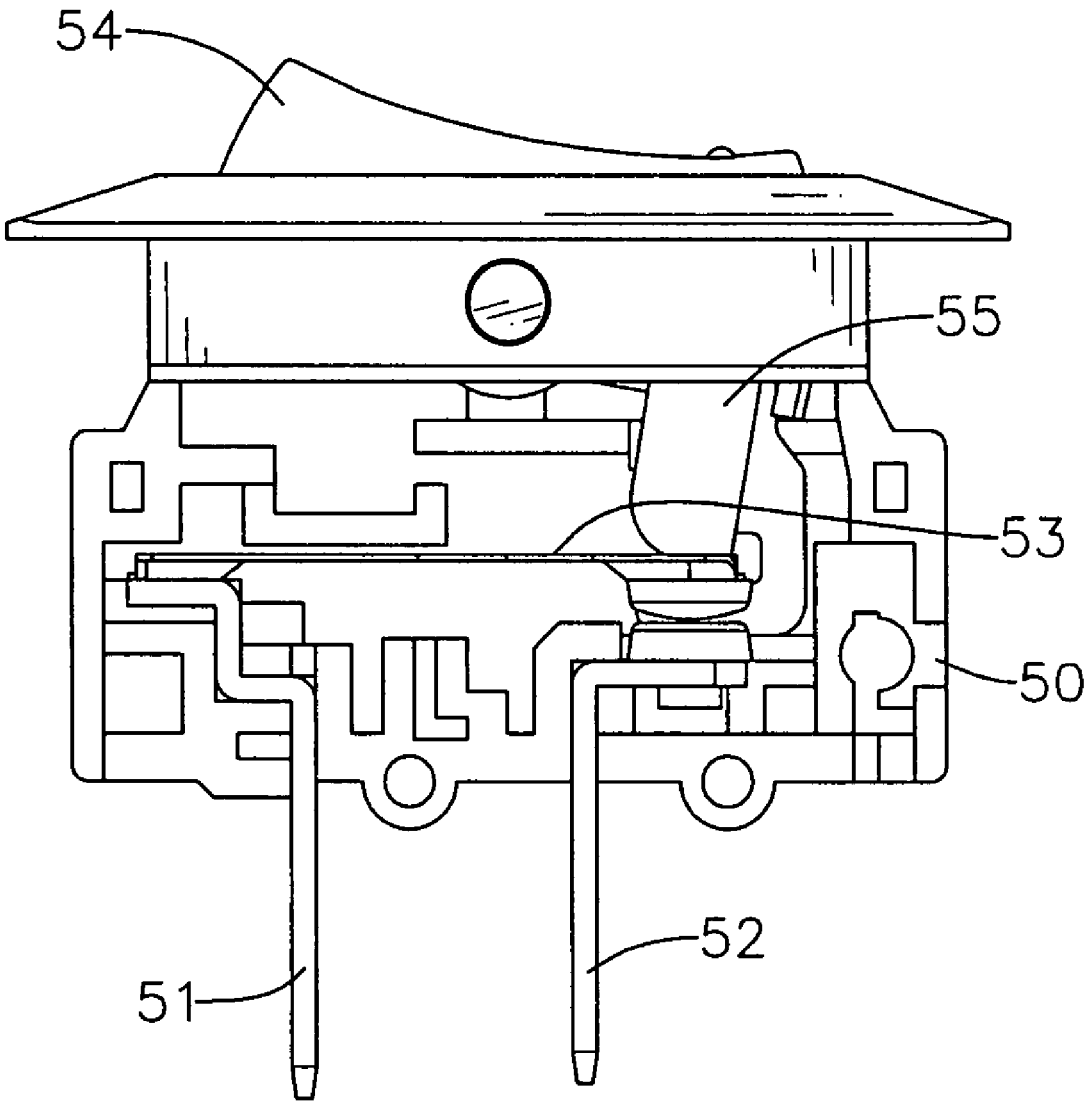
FIG. 5 PRIOR ART
FIG. 5 is a side view of the conventional over current cut-off switch for the power supply in accordance with the prior art.
Figure 6:
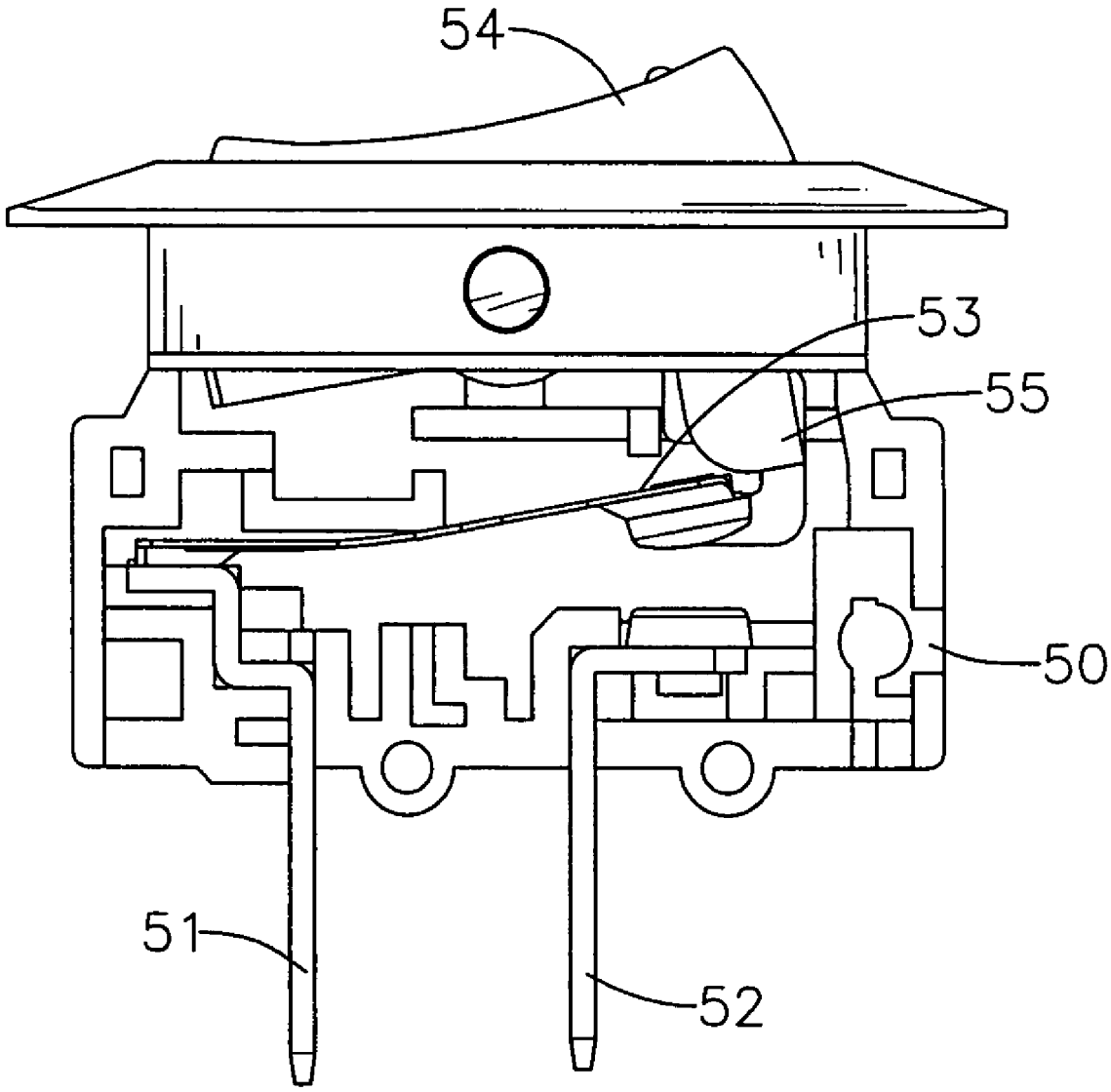
FIG. 6 PRIOR ART
FIG. 6 is an operational side plan view of the conventional over current cut-off switch for the power supply in accordance with the prior art.

With reference to FIG. 2 and FIG. 3, operations of the over current cut-off switch of the present invention are introduced as follows. The free end of the reed 20 contacts the top of the second conductive foot 11 when an electric current of the power supply is normal. Once an over current flows from the first conductive foot 10 through the reed 20 to the second conductive foot 11, a part of the current flows to the electric wire 21, so as to branch the over current. In this way, the riveted point 30 can avoid breaking off due to the over current.

While the invention has been described by way of example and in terms of a preferred embodiment, it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. An over current cut-off switch comprising:

an electric insulating housing;

a first conductive foot and a second conductive foot, wherein upper portions of the first conductive foot and the second conductive foot are configured inside the electric insulating housing, wherein lower portions of the first conductive foot and the second conductive foot are penetrating outside the electric insulating housing;

a reed having a first end and a second end, wherein a bottom of the second end is separately connected to a top of the second conductive foot;

a connecting conductor mounted between the first end of the reed and the upper portion of the first conductive foot;

an electric wire mounted between the first end of the reed and the upper portion of the first conductive foot; and a switch button configured on a top of the electric insulating housing, wherein one side of a bottom of the switch button has a bump, wherein the bump penetrates inside the electric insulating housing and faces a top of the second end of the reed.

2. The over current cut-off switch as claimed in claim 1, wherein the connecting conductor is riveted to the first end of the reed and the upper portion of the first conductive foot.

3. The over current cut-off switch as claimed in claim 1, wherein the electric wire has two ends, wherein one end of the electric wire is mounted to an inner surface of the first conductive foot and the other end of the electric wire is mounted to a bottom of the reed.

4. The over current cut-off switch as claimed in claim 2, wherein the electric wire has two ends, wherein one end of the electric wire is mounted to an inner surface of the first conductive foot and the other end of the electric wire is mounted to a bottom of the reed.

5. The over current cut-off switch as claimed in claim 1, wherein the electric wire is a woven copper wire.

6. The over current cut-off switch as claimed in claim 2, wherein the electric wire is a woven copper wire.

7. The over current cut-off switch as claimed in claim 3, wherein the electric wire is a woven copper wire.

8. The over current cut-off switch as claimed in claim 4, wherein the electric wire is a woven copper wire.

9. The over current cut-off switch as claimed in claim 1, wherein the reed and the connecting conductor are of a copper alloy sheet metal.

10. The over current cut-off switch as claimed in claim 2, wherein the reed and the connecting conductor are of a copper alloy sheet metal.

11. The over current cut-off switch as claimed in claim 3, wherein the reed and the connecting conductor are of a copper alloy sheet metal.

12. The over current cut-off switch as claimed in claim 4, wherein the reed and the connecting conductor are of a copper alloy sheet metal.

13. The over current cut-off switch as claimed in claim 5, wherein the reed and the connecting conductor are of a copper alloy sheet metal.

14. The over current cut-off switch as claimed in claim 6, wherein the reed and the connecting conductor are of a copper alloy sheet metal.

15. The over current cut-off switch as claimed in claim 7, wherein the reed and the connecting conductor are of a copper alloy sheet metal.

16. The over current cut-off switch as claimed in claim 8, wherein the reed and the connecting conductor are of a copper alloy sheet metal.

* * * * *